US007319214B2

(12) United States Patent
Cho et al.

(10) Patent No.: US 7,319,214 B2
(45) Date of Patent: Jan. 15, 2008

(54) DOOR STRUCTURE OF MICROWAVE OVEN USABLE AS PIZZA OVEN

(75) Inventors: Yun Ho Cho, Incheon-si (KR); Kyung Hoi Yang, Bucheon-si (KR)

(73) Assignee: Daewoo Electronics Corporation, Seoul (KR)

( * ) Notice: Subject to any disclaimer, the term of this patent is extended or adjusted under 35 U.S.C. 154(b) by 0 days.

(21) Appl. No.: 11/382,864

(22) Filed: May 11, 2006

(65) Prior Publication Data

US 2006/0191920 A1 Aug. 31, 2006

Related U.S. Application Data

(63) Continuation of application No. 11/271,564, filed on Nov. 11, 2005, now abandoned, which is a continuation of application No. 11/014,021, filed on Dec. 16, 2004, now abandoned.

(30) Foreign Application Priority Data

| | | |
|---|---|---|
| Dec. 18, 2003 | (KR) | 2003-93026 |
| Jun. 23, 2004 | (KR) | 2004-47096 |
| Jun. 23, 2004 | (KR) | 2004-47097 |
| Jun. 23, 2004 | (KR) | 2004-47098 |

(51) Int. Cl.
*H05B 6/76* (2006.01)
*H05B 6/80* (2006.01)

(52) U.S. Cl. ..... 219/739; 219/685; 219/680; 219/756; 219/403; 99/451

(58) Field of Classification Search ..... 219/738–744, 219/680–685, 756, 402–403; 99/DIG. 14, 99/451

See application file for complete search history.

(56) References Cited

U.S. PATENT DOCUMENTS

| | | | | |
|---|---|---|---|---|
| 1,879,880 | A * | 9/1932 | Lindsey | 126/38 |
| 2,633,840 | A | 4/1953 | Crawford | |
| 2,873,737 | A | 2/1959 | Sherman | |
| 3,387,114 | A * | 6/1968 | Brake, Jr. et al. | 219/386 |
| 5,085,433 | A | 2/1992 | Parsons | |
| 5,144,105 | A | 9/1992 | Briggs et al. | |
| 5,534,679 | A | 7/1996 | Beaver et al. | |
| 5,810,403 | A | 9/1998 | Prada | |
| 6,414,278 | B1 | 7/2002 | Frohlich et al. | |
| 6,539,840 | B2 | 4/2003 | Choi et al. | |
| 6,624,399 | B2 | 9/2003 | Rypan | |

FOREIGN PATENT DOCUMENTS

| | | |
|---|---|---|
| JP | 01179826 A | 7/1989 |
| JP | 02004131 A | 1/1990 |

* cited by examiner

*Primary Examiner*—Philip H. Leung
(74) *Attorney, Agent, or Firm*—Workman Nydegger

(57) ABSTRACT

A door structure of a microwave oven usable as a pizza oven, wherein a pan is coupled to an inner surface of the door such that the pan is integral with the door, and a handle is mounted to an outer surface of the door. The handle has various structures so that the handle is separable from the door or is hingably mounted to the door to move between a folded state and an unfolded state. The door structure, may be configured to simultaneously open the door and eject the pan. The user can stably open and close the pizza oven door, using only a handle, under the condition in which the pizza oven door and pizza tray are not supported. The handle has a structure capable of effectively supporting the weight of the oven door while having a foldable structure so that the handle can be conveniently used.

1 Claim, 7 Drawing Sheets

DOOR STRUCTURE OF MICROWAVE OVEN USABLE AS PIZZA OVEN

CROSS-REFERENCE TO RELATED APPLICATIONS

This application is a continuation of U.S. application Ser. No. 11/271,564, filed Nov. 11, 2005 now abandoned, which is a continuation of U.S. application Ser. No. 11/014,021, filed Dec. 16, 2004 now abandoned, which claims priority to Korean Application No. 2003-93026, filed Dec. 18, 2003; Korean Application No. 2004-47096 filed Jun. 23, 2004; Korean Application No. 2004-47097 filed Jun. 23, 2004; and Korean Application No. 2004-47098, filed on Jun. 23, 2004, each of the foregoing being incorporated herein by specific reference in their entirety.

BACKGROUND OF THE INVENTION

1. The Field of the Invention

The present invention relates to a door structure of a microwave oven usable as a pizza oven and a structure of a door handle thereof, and, more particularly, to a door structure of a microwave oven usable as a pizza oven, in which a pan, on which a pizza is to be cooked, and a door are integral with each other, and the door is hingable about one side of the door, so that the pan is ejected from a cooking chamber when the door hinges to open the cooking chamber, and a handle structure used in the door structure, which not only allows the user to stably take a cooked pizza out of the cooking chamber, thereby achieving an improvement in convenience, but also provides a reliable seal effect between the door and the cooking chamber, thereby preventing heat from being leaked from the cooking chamber, and thus, achieving an improvement in cooking performance.

2. The Relevant Technology

Microwave ovens are well known. Microwave ovens are kitchen appliances which irradiate microwaves emitted from a magnetron onto food to be cooked, and thus, heat both the outside and inside of the food. Accordingly, such microwave ovens exhibit a high thermal efficiency, so that they can greatly reduce the time taken to cook food, can reduce loss of nutritive elements generated during operations of cooking, thawing, and heating food, and can directly cook food in a state in which the food is stored in a container. By virtue of such advantages, the microwave oven has been widely used.

Since the above-mentioned microwave oven is used to simply heat food, the microwave oven is equipped with only one cooking chamber to heat food. However, new microwave ovens have recently been developed which include a separate pizza cooking chamber to heat pizza, in particular, frozen pizza. Such a microwave oven is illustrated in FIG. 1.

FIG. 1 illustrates a perspective view schematically illustrating a conventional microwave oven, which is usable as a pizza oven. As shown in FIG. 1, the microwave oven, which is designated by reference numeral 1, includes an oven body defined with a cooking chamber 2 and an electric device installation chamber (not shown). A pizza cooking chamber 6 is defined in an upper portion of the cooking chamber 2.

A control panel 10 is arranged at one side of the oven body, for example, the front side of the oven body, as in the illustrated case. The control panel 10 includes a key panel 12 to be used to operate the microwave oven to cook pizza in the pizza cooking chamber 6 (hereinafter, this key panel is referred to as a "pizza key panel"), and a key panel 14 to be used to operate the microwave oven to cook general food other than pizza in the cooking chamber 2 (hereinafter, this key pad is referred to as a "cooking key panel").

Upper and lower heaters 20 are fixedly mounted to the top and bottom of the pizza cooking chamber 6 in the interior of the pizza cooking chamber 6, respectively. Guide members 7 are mounted to opposite side walls of the oven body defining opposite lateral sides of the pizza cooking chamber 6 to guide movement of a pizza tray 40 to be described hereinafter, respectively.

A pizza oven door 30 is slidably mounted to the oven body to open/close the pizza cooking chamber 6. The pizza tray 40, on which a pizza to be cooked will be laid, is fixedly mounted to an inner surface (back surface) of the pizza oven door 30 to extend toward the interior of the pizza cooking chamber 6. A handle 32 is fixedly attached to an outer surface (front surface) of the pizza oven door 30.

The pizza laid on the pizza tray 40 is heated by heat transferred thereto from the upper and lower heaters 20.

The upper and lower heaters 20 are electrically connected to the pizza key panel 12 so that the upper and lower heaters 20 are operated in accordance with operation of the pizza key panel 12 to generate heat, thereby causing the pizza laid on the pizza tray 40 to be cooked.

When it is desired to cook a pizza in the microwave oven 1, which is usable as a pizza oven in accordance with the above-mentioned configuration, the user first lays the pizza on the pizza tray 40. Thereafter, the user couples the pizza oven door 30 to the pizza cooking chamber 6, and then pushes the pizza oven door 30 to move the pizza tray 40 into the pizza cooking chamber 6 along the guide members 7, and thus, to close the pizza cooking chamber 6.

When the user then operates the pizza key panel 6 included in the control panel 10, the upper and lower heaters 20 are operated to generate heat, so that the pizza received in the pizza cooking chamber 6 is cooked by the generated heat.

After completion of the cooking of the pizza, the user pulls the pizza oven door 30 while grasping the handle 32, to take the cooked pizza out of the pizza cooking chamber 6.

In order to take the cooked pizza out of the microwave oven, the user must open the pizza oven door 30, and then eject the pan, on which the pizza is laid, using a separate ejection tool, in a state of wearing hot gloves. However, such an operation is inconvenient. That is, inconvenience is caused when the user ejects the pan from the pizza cooking chamber because he must open the pizza oven door 30 using one hand, and perform the ejection of the pan using the grasping tool while grasping the ejection tool by the other hand. Furthermore, there is a problem in that the user may burn himself if carelessly handling the pan.

Meanwhile, the handle 32, which may have various shapes, is attached to the pizza oven door 30. However, the handle 32 may obstruct movement of the user around the microwave oven when the microwave oven is not in use, because the handle is typically fixed to the front side of the pizza oven door 30 in a protruded state.

Furthermore, the pizza oven door 30 is slidably movable with respect to the pizza cooking chamber 6 to open/close the pizza cooking chamber 6. When it is desired to completely open the pizza cooking chamber 5, the user must completely separate the pizza oven door 30 from the pizza cooking chamber 6, using the handle 32. Where the user performs the separation of the pizza oven door 30 from the pizza cooking chamber 6 while grasping only the handle 32, the pizza oven door 30 may be rendered to be rearwardly inclined due to the weight of the pizza oven door 30, without being maintained in a horizontal state. As a result, a considerable force is required to horizontally eject the pizza tray 40. In particular, most women cannot firmly maintain the pizza oven door 30 in a horizontal state, so that the pizza may be dropped from the pizza tray 40. In this case, a dangerous situation may occur because the user must hold the hot pizza tray to prevent the pizza from being dropped. Thus, the conventional pizza oven door has a problem in that the opening and closing operations thereof are unstable and inconvenient.

Moreover, the center of gravity of the pizza oven door 30 including the pizza tray 40 is positioned at a position rearwardly spaced apart from the pizza oven door 30. For this reason, the handle 32 may be broken during the ejection of the pizza oven door 30 unless the handle 32 has a sufficient strength.

Since the conventional pizza oven door 30 is movable with respect to the pizza cooking chamber 6 in a general sliding manner, the pizza cooking chamber 6 may be incompletely sealed by the pizza oven door 30, so that the thermal energy of high-temperature heat generated from the upper and lower heaters 20 may be leaked during the procedure of cooking the pizza by the heat from the upper and lower heaters 20. As a result, a degradation in cooking performance occurs. In addition, there is a problem in that odor generated during the pizza cooking operation may be severely leaked

SUMMARY OF THE INVENTION

The present invention has been made in view of the above-mentioned problems, and it is an object of the invention to provide a means capable of simultaneously achieving opening of a pizza oven door and ejection of a pan in a pizza oven.

Another object of the invention is to provide a means capable of detachably mounting a handle to a pizza oven door, or folding the handle, if desired.

Another object of the invention is to provide a door structure of a microwave oven usable as a pizza oven, which enables the user to stably open and close a pizza oven door, using only a handle, under the condition in which the pizza oven door and a pizza tray mounted to the pizza oven door are not supported by a separate support force during the procedure of opening and closing the pizza oven door.

Another object of the invention is to provide a handle structure of a microwave oven usable as a pizza oven, which includes a handle to open/close a pizza oven door, the handle being capable of effectively supporting the weight of the pizza oven door while having a foldable structure so that the handle can be conveniently used.

Still another object of the invention is to provide a door of a pizza oven incorporated in a microwave oven, which can securely seal the pizza oven to prevent leakage of thermal energy required to cook pizza from the interior of the pizza oven, and thus, to prevent a degradation in cooking performance.

In accordance with one aspect, the present invention provides a door structure of a microwave oven usable as a pizza oven, the microwave oven including an oven body, electric heating wires installed in the oven body, a pan to be inserted into or ejected from a cooking chamber defined in the oven body, and a door to open/close an inlet of the cooking chamber, the door structure comprising: the pan coupled to an inner surface of the door such that the pan is integral with the door; and a handle mounted to an outer surface of the door. The handle may have various structures so that the handle is separable from the door or is hingably mounted to the door to move between a folded state and an unfolded state.

In accordance with another aspect, the present invention provides a microwave oven usable as a pizza oven, the microwave oven comprising an oven body, a cooking chamber defined in the oven body, and an oven chamber defined in the oven body while being separate from the cooking chamber, wherein: the oven chamber is used as a pizza oven chamber only to cook pizza; and the microwave oven further comprises a door structure to open/close the oven chamber, the door structure comprising: a hinge door hingably mounted to a front side of the oven body to open/close the oven chamber in accordance with a hinging operation of the hinge door; and a pizza tray provided at an inner surface of the door such that the pizza tray is integral with the door, the pizza tray supporting an object laid, to be cooked, on the pizza tray in the oven chamber, whereby, when the hinge door hinges to open the oven chamber, the pizza tray is outwardly ejected while being hinged together with the hinge door. The pizza tray may be mounted to the hinge door, using a riveting method, such that the pizza tray is integral with the hinge door.

In accordance with another aspect, the present invention provides a microwave oven usable as a pizza oven, the microwave oven comprising a cooking chamber, an oven chamber separate from the cooking chamber, in particular, a pizza oven chamber only to cook pizza, the microwave oven further comprising a pizza oven door hingably mounted at an inlet of the pizza oven chamber to open/close the pizza oven chamber. In this case, it is possible to easily support the pizza oven door.

In accordance with another aspect, the present invention provides a door structure of a microwave oven usable as a pizza oven, the microwave oven comprising an oven body, a cooking chamber defined in the oven body, and a pizza oven chamber defined in the oven body while being separate from the cooking chamber, the door structure comprising: a door to open/close the pizza oven chamber; and a foldable handle hingably mounted to an outer surface of the door such that the foldable handle hinges between a folded state and an unfolded state, and is able to be maintained in the unfolded state. The foldable handle may comprise: a handle section having a circular bar shape; a bracket to mount the handle section to an outer surface of the door; a hinge to hingably mount the handle section to the bracket such that the handle section hinges horizontally; a slit formed at one side of the bracket to open one side of the bracket and to guide the horizontal hinging operation of the handle section; a lever to temporarily hold the handle section at positions respectively corresponding to opposite ends of the slit, the lever having a pusher, and an engagement protrusion to be engaged with the bracket at the holding positions and to be disengaged from the bracket in accordance with a pushing operation of the pusher, and elastic means to elastically support the lever such that the engagement protrusion is always forced in an engaging direction.

The foldable handle can effectively support the weight of the pizza oven door and the weight of the pizza tray integral with the pizza oven door.

In accordance with another aspect, the present invention provides a door structure of a pizza oven incorporated in a microwave oven, the pizza oven comprising an oven chamber, and a door to open/close the oven chamber, the door structure comprising: seal locking means mounted to the door to bring the door into close contact with an inlet of the oven chamber. The seal locking means may comprise: a handle mounted to an outer surface of the door; a locking lever hingably mounted, at an intermediate portion thereof, to a hinge arranged in the interior of the door; a pusher extending from one end of the locking lever such that the pusher is integral with the locking lever, the pusher being arranged beneath the handle; a locker formed at the other end of the locking lever such that the locker is engagable with an inlet edge of the oven chamber; and an elastic member interposed between the pusher and the handle to force the pusher to move away from the handle, and thus, to bring the locker into contact with the inlet edge of the oven chamber under pressure. The seal locking means may further comprise an elastic seal pad attached to a selected one of the locker and the inlet edge of the oven chamber

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

FIGS. 5A and 5B illustrate a pizza oven door according to a third embodiment of the present invention, in which FIG. 5A is a perspective view, and FIG. 5B is a partially-enlarged side sectional view;

DETAILED DESCRIPTION OF THE PREFERRED EMBODIMENTS

Hereinafter, exemplary embodiments of the present invention will be described in detail with reference to the annexed drawings.

Figure 1:
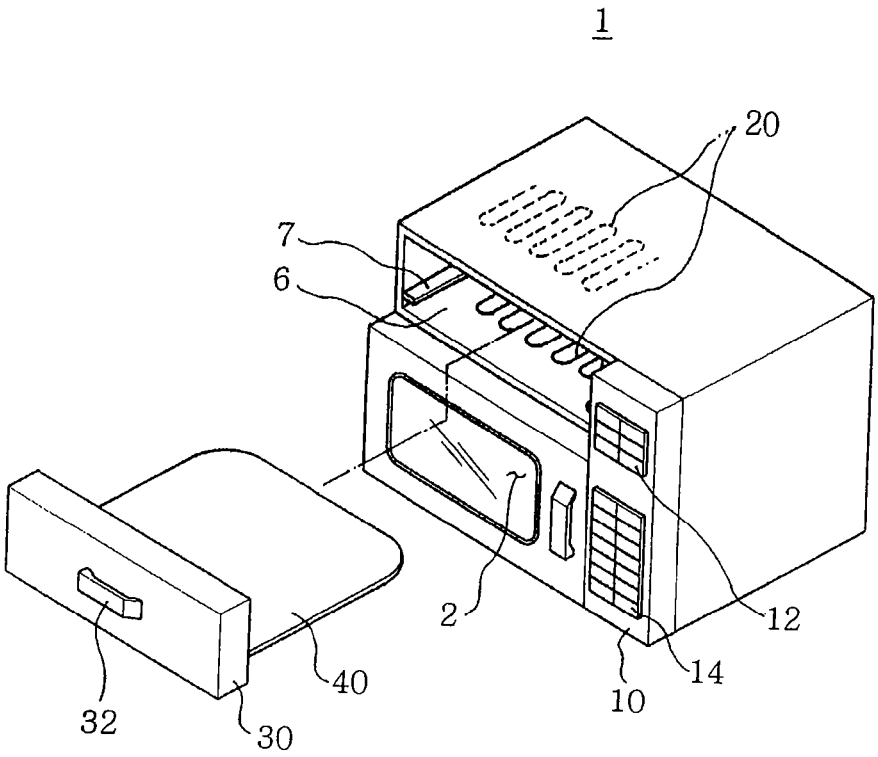
FIG. 1 (PRIOR ART)
FIG. 1 is a perspective view schematically illustrating a conventional microwave oven, which is usable as a pizza oven.
Figure 2:
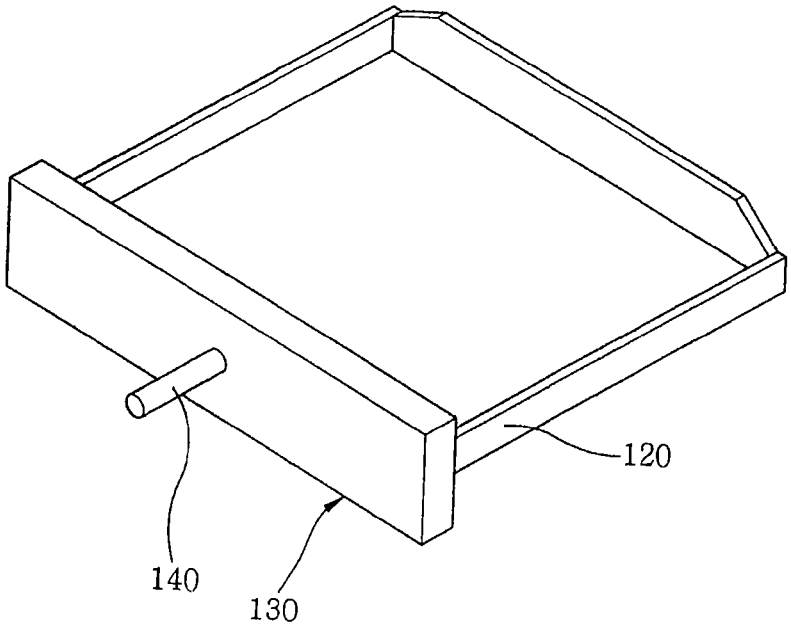
FIG. 2 is a perspective view illustrating a door according to a first embodiment of the present invention.
Figure 3:
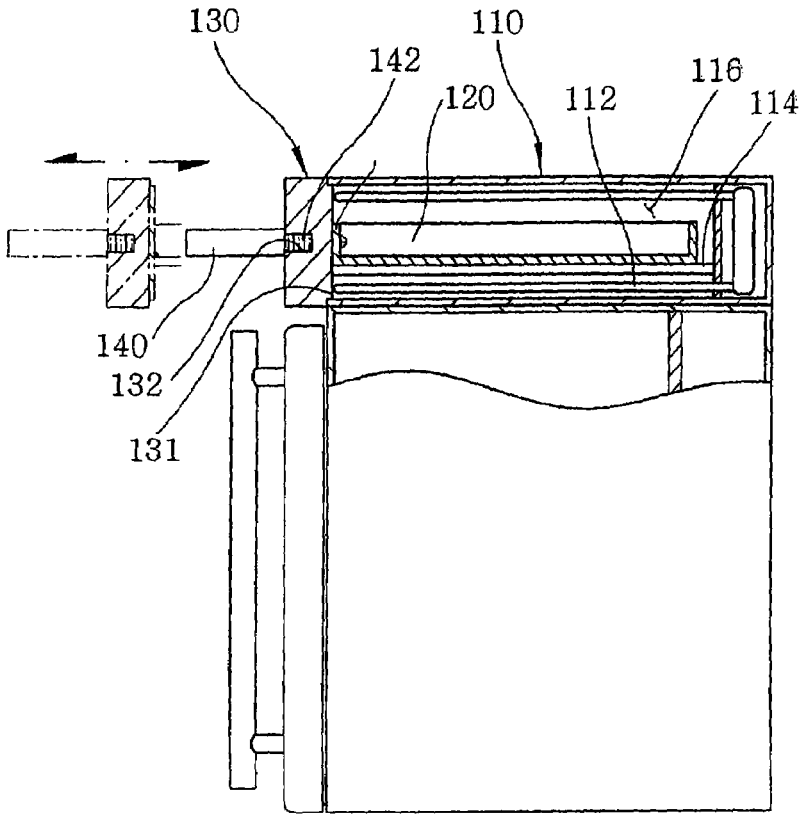
FIG. 3 is a side sectional view illustrating a mounted state of the door shown in FIG. 2.

Referring to FIGS. 2 and 3, a pizza oven door according to a first embodiment of the present invention is illustrated. As shown in FIGS. 2 and 3, the pizza oven door, which is designated by reference numeral 130, carries a pan 120, which is fixed to the pizza oven door 130 by means of welding. In detail, the pan 120 is welded to the pizza oven door 130 in a state in which one end of the pan 120 comes into contact with an inner surface of the door 130, so that the pan 120 is integral with the door 130.

The door 130 is slidably and separably coupled to a pizza oven chamber 116 defined in an oven body 110. The door 130 is formed with a step extending along the peripheral edge of the inner surface of the door 130 to form a fitting section to be fitted in an inlet of the pizza oven chamber 116 in a state in which the door 130 moves to a closing position.

A handle 140 is separably mounted to an outer surface of the door 130. For the mounting of the handle 140, a fastening hole 132 formed with female threads is formed at a central portion of the door 130 such that the fastening hole 132 extends inwardly from the outer surface of the door 130. Also, the handle 140 has, at one end thereof, a fastening portion 142 formed with male threads. The fastening portion 142 of the handle 140 is fastened to the fastening hole 132 to fasten the handle 140 to the door 130.

Thus, the handle 140 can be fastened to the door 130 or can be separated from the door 130, if necessary. Accordingly, it is possible to prevent the handle 140 from obstructing movement of the user around the oven by separating the handle 140 from the door 130.

The door 130, which is integral with the pan 120 and carries the handle 140 in a separable state, is slidable to be coupled with the oven body 110 or to be separated from the oven body 110, and thus, to close or open the pizza oven chamber 116.

Hereinafter, operation of the pizza oven door according to the first embodiment of the present invention will be described.

In order to close the pizza oven chamber 116, the user pushes the door 130 integrally carrying the pan 120 welded to the inner surface of the door 130 to insert the pan 120 into the pizza oven chamber 116 while grasping the handle 140, as shown in FIG. 3. The insertion of the pan 120 is guided by guide rails 114 attached to the oven body 110 at opposite sides of the pizza oven chamber 116 as the opposite lateral edges of the pan 120 slide along the guide rails 114, respectively.

When the pan 120 is completely inserted, the inlet of the pizza oven chamber 116 is closed by the door 130. That is, when the user pushes the door 130 such that the pan 120 is inserted into the pizza oven chamber 116 until the fitting portion 131 of the door 130 is fitted in the inlet of the pizza oven chamber 116, so that the pizza oven chamber 116 is closed.

Thus, it is possible to easily load the pan 120 in the pizza oven chamber 116 simply by horizontally pushing the door 130 integrally carrying the pan 120 such that the pan 120 is inserted into the pizza oven chamber 116. In accordance with this door pushing operation, the pizza oven chamber 116 can also be reliably closed by the door 130.

After completion of the loading of the pan 120 in accordance with the above-described operation, electric power is applied to electric heating wires installed in the pizza oven chamber 116, so that cooking of a pizza laid on the pan 120 is initiated.

After completion of the cooking of the pizza, the user horizontally pulls the door 130 while grasping the handle 140 of the door 130. In accordance with only the pulling operation, opening of the pizza oven chamber 116 and ejection of the pan 120 are simultaneously achieved.

That is, the door 130 opens the pizza oven chamber 116 in accordance with only the user's operation to forwardly pull the door 130 while grasping the handle 140 attached to the outer surface of the door 130. Simultaneously with the opening of the pizza oven chamber 116, the pan 120 is ejected while being guided by the guide rails 114.

Thus, the user can perform both the opening of the door 130 and the ejection of the pan 120, using only one hand. Accordingly, the other hand of the user can be used to assist the hand grasping the handle 140. Therefore, the user can more stably handle the pan 120. Also, the convenience of the user is enhanced.

Meanwhile, the pan 120 may be threadedly coupled to the door 130. In this case, the pan 120 is provided with a fastening portion 122 at an end of the pan 120 facing the inner surface of the door 130. The fastening portion 122 of the pan 120 is fastened to the inner surface of the door 130 by means of screws in a state of coming into contact with the inner surface of the door 130.

Where the pan 120 is integrally coupled to the door 130 by means of screws, as described above, it is possible to replace the pan 120 or door 130 with a new one by unfastening the screws when the pan 120 or door 130 is damaged.

Figure 4:
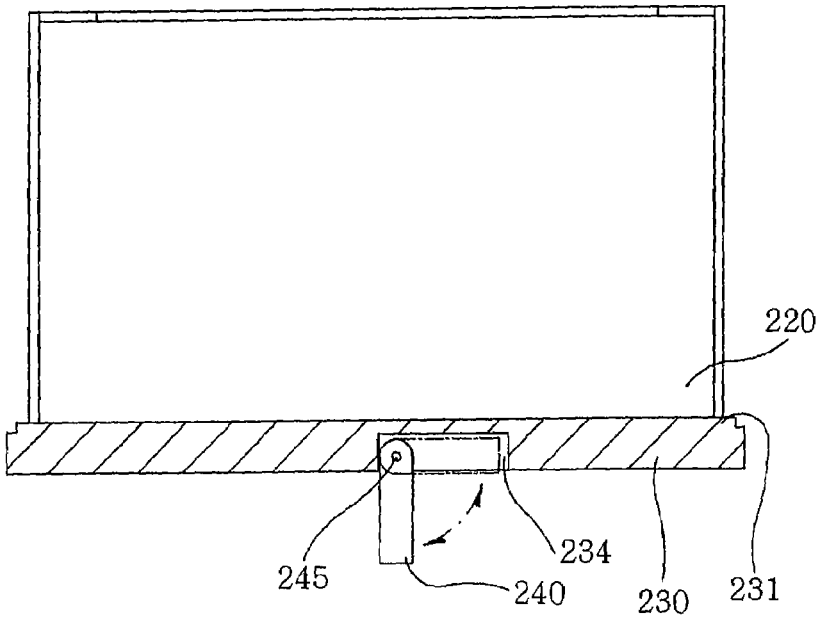
FIG. 4 is a partially-enlarged sectional view illustrating a door according to a second embodiment of the present invention.

FIG. 4 illustrates a pizza oven door according to a second embodiment of the present invention. As shown in FIG. 4, the pizza oven door of the second embodiment, which is designated by reference numeral 230, has the same structure as that of the first embodiment, except that a handle receiving recess 234 is formed at the outer surface of the door 230 such that the handle receiving recess 234 extends horizontally, and a handle 240 is hingably coupled, at one end thereof, to the door 230 in the handle receiving recess 234 at one side of the handle receiving recess 234 by a hinge 245 such that the handle 240 is foldable.

Since the handle 240 is hingably mounted to the door 230 in the handle receiving recess 234, the handle 240 is hinged about the hinge 245 in a direction spaced away from the door 230, that is, a forward direction, when the user pulls the other end of the handle 240 to use the handle 240. Thus, the handle 240 is unfolded in a state of protruding from the outer surface of the door 230. Accordingly, the user can grasp the handle 240.

When it is unnecessary to use the handle 240, the user pushes the handle 240 to receive the handle 240 in the handle receiving recess 234, and thus, to prevent the handle 240 from protruding from the outer surface of the handle 240. Thus, the handle 240 does not obstruct movement of the user around the oven.

Figure 5A:
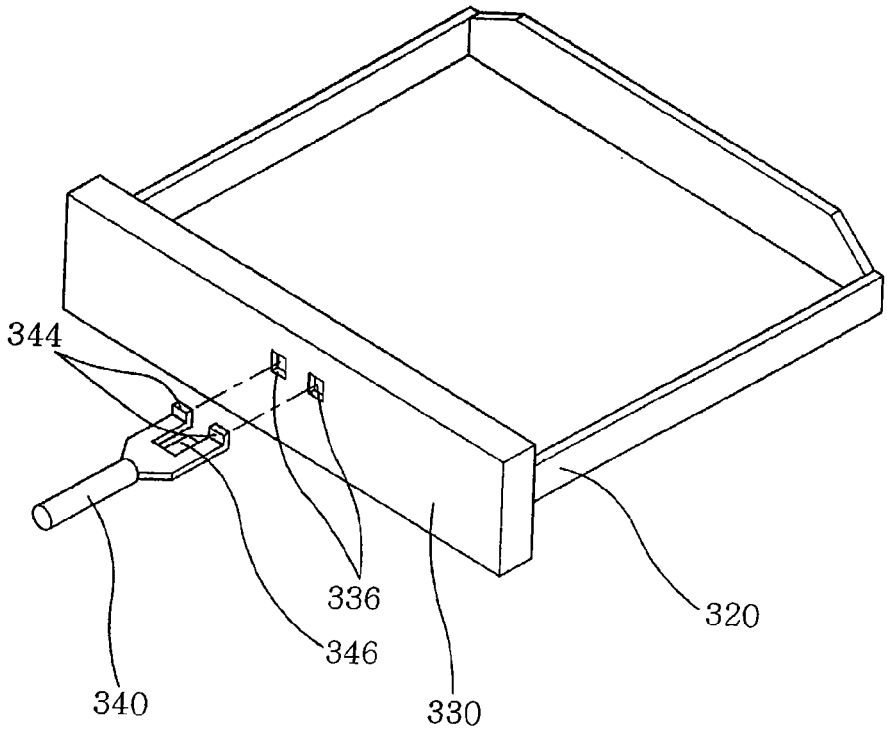
Figure 5B:
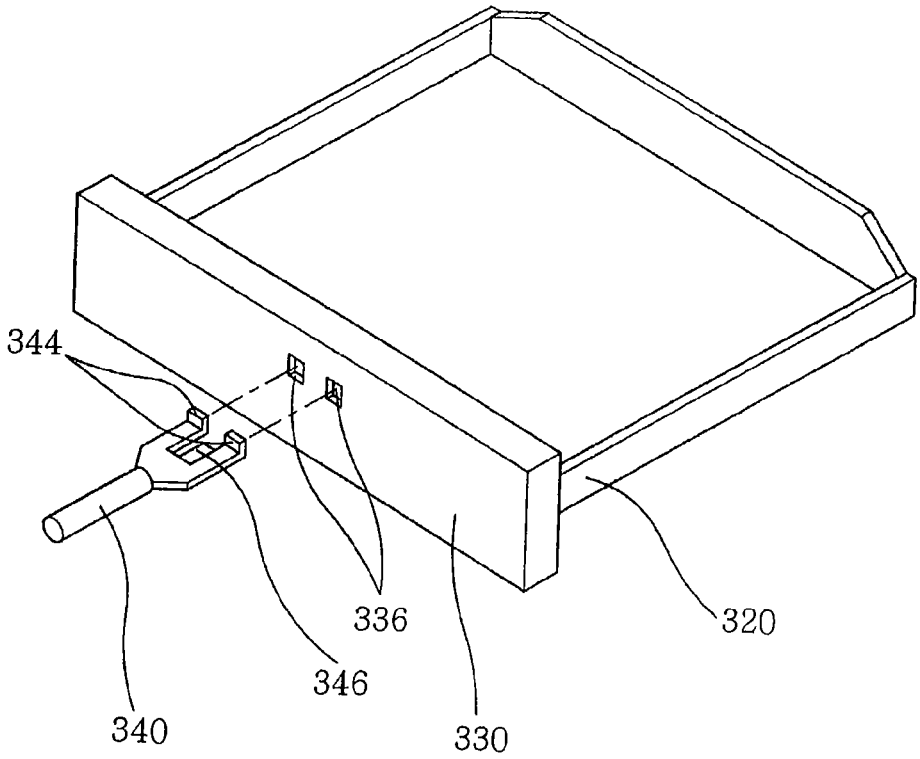

FIGS. 5A and 5B illustrate a pizza oven door according to a third embodiment of the present invention. As shown in FIGS. 5A and 5B, the pizza oven door of the third embodiment, which is designated by reference numeral 330, has the same structure as that of the first embodiment, except that the pizza oven door includes a pair of engagement grooves 336 formed at the front surface of the door 330, a pair of horizontally-spaced engagement portions 344 formed at one end of the handle 340 to be engaged with respective engagement grooves 336, and a support portion 346 arranged between the engagement portions 334 beneath the engagement portions 334.

In order to use the handle 340 of the above-described structure in which the engagement portions 344 and support portion 346 are provided at the handle 340, and the engagement grooves 336 to be engaged with the engagement portions 344 are provided at the outer surface of the door 330, the user first inserts the engagement portions 344 into the engagement grooves 336 while grasping the other end of the handle 340, and then downwardly presses the other end of the handle 340 until the support portion 346 comes into contact with the outer surface of the door 330. In this state, the engagement portions 344 are firmly engaged with the engagement grooves 336, so that the handle 340 is firmly coupled to the door 330.

In order to separate the handle 340 from the door 330 in the above-described coupled state, the user raises the other end of the handle 340. In accordance with this operation of the user, the support portion 346 is spaced away from the outer surface of the door 330, and the engagement portions 344 are downwardly moved. When the user forwardly pulls the handle 340 in this state, the engagement portions 344 are removed from the engagement grooves 336. Thus, the handle 340 is separated from the door 330.

In accordance with the structure in which the handle 340 is separably coupled to the door 330 integrally carrying the pan 320, it is possible to mount the handle 340 only in a required case. Accordingly, when it is unnecessary to use the handle 340, the user can separate the handle 340 from the door 330 to prevent the handle 340 from obstructing movement of the user around the oven.

Figure 6:
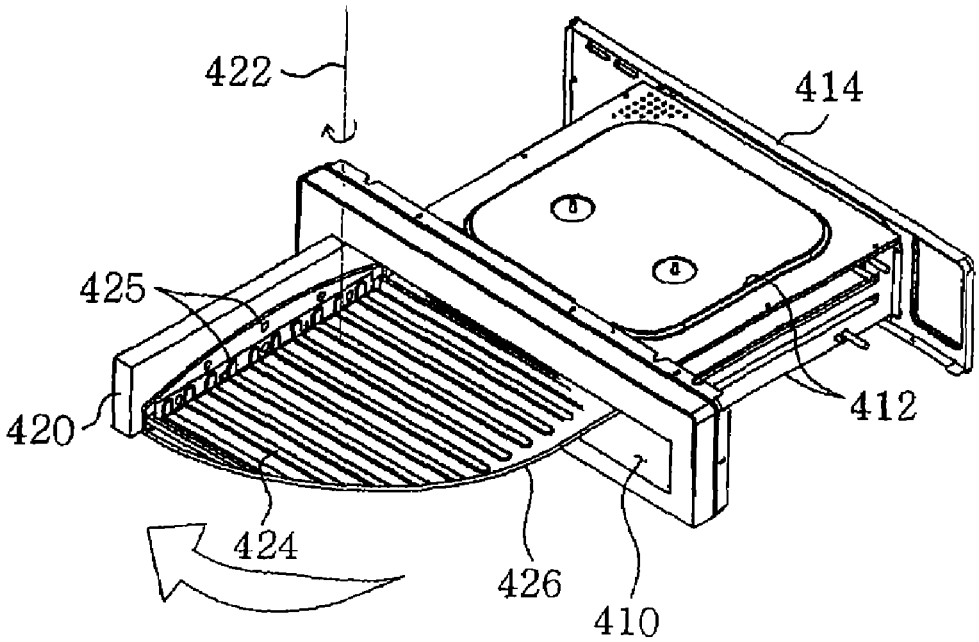
FIG. 6 is a perspective view illustrating a pizza oven incorporated in a microwave oven in accordance with a fourth embodiment of the present invention.
Figure 7:
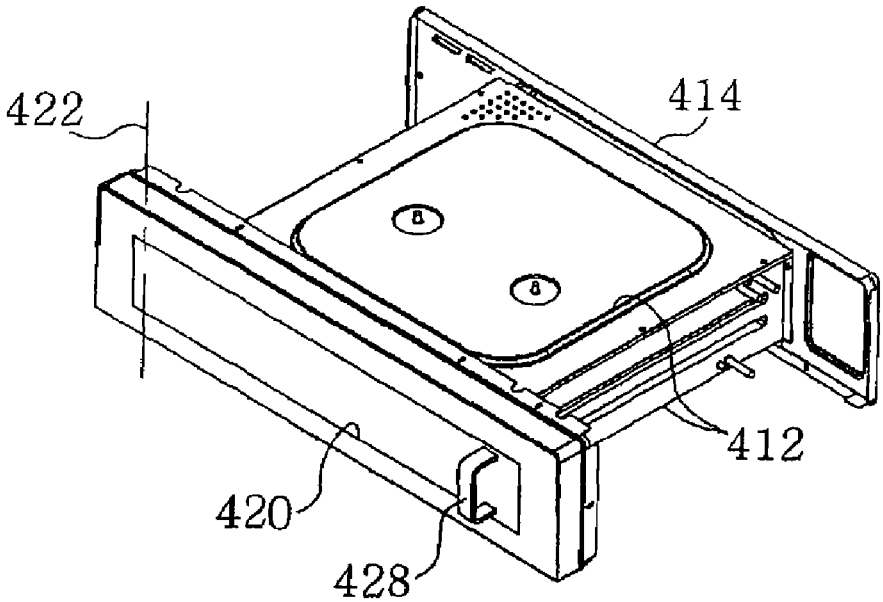
FIG. 7 is a perspective view illustrating a closed state of the pizza oven shown in FIG. 6.

FIG. 6 is a perspective view illustrating a pizza oven incorporated in a microwave oven in accordance with a fourth embodiment of the present invention. FIG. 7 is a perspective view illustrating a closed state of the pizza oven shown in FIG. 6.

The microwave oven according to the fourth embodiment of the present invention includes a pizza oven chamber 410 defined, only to cook pizza, in an upper portion of the microwave oven, which includes a cooking chamber (not shown) arranged in a lower portion of the microwave oven to cook food, using microwaves or heat from an electric heater.

The pizza oven includes a pizza oven body mounted to an oven body of the microwave oven, a pair of heaters 412 respectively mounted to the pizza oven body to define the top and bottom of the pizza oven chamber 410, a frame 414 mounted to the pizza oven body to define the rear side of the pizza oven chamber 410. The pizza oven body is opened at the front side thereof. A hinge door 420 is hingably mounted to the front side of the pizza oven body such that the hinge door 420 is horizontally hingable with respect to the pizza oven body.

A hinge 422 is mounted to the hinge door 420 at one side of the hinge door 420 to hingably mount the hinge door 420 to the pizza oven body. Thus, the hinge door 420 is hingably movable to open/close the pizza oven chamber 410.

A pizza tray 424, on which a pizza to be cooked in the pizza oven chamber 410 will be laid, is mounted to the inner surface of the hinge door 420 such that the pizza tray 424 is integral with the hinge door 420. In the illustrated case, rivet holes 425 are formed at the hinge door 420 and pizza tray 424 so that the pizza tray 424 can be integrally mounted to the hinge door 420 by means of riveting.

In order to prevent the pizza tray 424 from interfering with the lateral side of the pizza oven chamber 410 opposite to the hinge 422 during the hinging operation of the hinge door 420, the pizza tray 424 is formed with an arc-shaped edge 426 at the side of the pizza tray 424 to move along the lateral side of the pizza oven chamber 410 during the hinging operation of the hinge door 420.

Thus, when the hinge door 420 hinges to open the pizza oven chamber 410, the pizza tray 424 is outwardly ejected while hinging together with the hinge door 420.

The operation of the pizza oven having the above-described structure according to the fourth embodiment of the present invention will now be described.

As described above, the microwave oven according to the fourth embodiment of the present invention has a pizza cooking function because the pizza oven is installed at the upper portion of the microwave oven. In FIG. 7, the hinge door 420, which is provided at the front surface thereof with a handle 428, is illustrated in a state of closing the pizza oven chamber 410.

When the user pulls the handle 428 to use the pizza oven, the hinge door 420 is hinged about the hinge 422, thereby opening the pizza oven chamber 410, as shown in FIG. 2.

As the pizza oven chamber 410 is opened, the pizza tray 424 integral with the hinge door 420 is outwardly ejected. Thereafter, the user lays a pizza, to be cooked, on the pizza tray 424, and then closes the hinge door 420 using the handle 428. In accordance with the user's operation, the hinge door 420 hinges about the hinge 422, thereby closing the pizza oven chamber 410.

In this state, the pizza can be cooked in accordance with a predetermined pizza cooking procedure. When the user pulls the handle 428 of the hinge door 420 after completion of the pizza cooking procedure, the hinge door 420 is hinged about the hinge 422 in an opening direction.

At this time, the cooked pizza is still in a state of being laid on the pizza tray 424, which is ejected in accordance with the opening of the hinge door 420. During the ejection of the pizza tray, the cooked pizza is maintained in a horizontal state without being inclined. That is, since the hinge door 420 is supported by the hinge 422, it is unnecessary to use a separate support force to support the weight of the pizza and the weight of the pizza tray 424. Accordingly, it is possible to stably take the cooked pizza out of the pizza tray 424.

Thus, the user can take the pizza out of the pizza tray 424 without additionally holding the pizza tray 424 or without using any separate support force because the pizza tray 424 is ejected in a state of being supported by the hinge door 420, simultaneously with the opening of the hinge door 420.

The hinge door 420 may be automatically openable/closable, using a separate driving means, for example, a drive motor controlled in response to ON/OFF of a microswitch. Alternatively, a solenoid type driving means may be used to automatically open/close the hinge door 420.

Thus, in accordance with this embodiment, the pizza tray 424 is integral with the hinge door 420 adapted to open/close the pizza oven chamber 410, so that the pizza tray 424 can be ejected, simultaneously with an opening operation of the hinge door 420 hinging about the hinge 422. Accordingly, the user can stably take the cooked pizza out of the pizza tray 424 without holding the hot pizza tray 424 by a separate support force.

Figure 8:
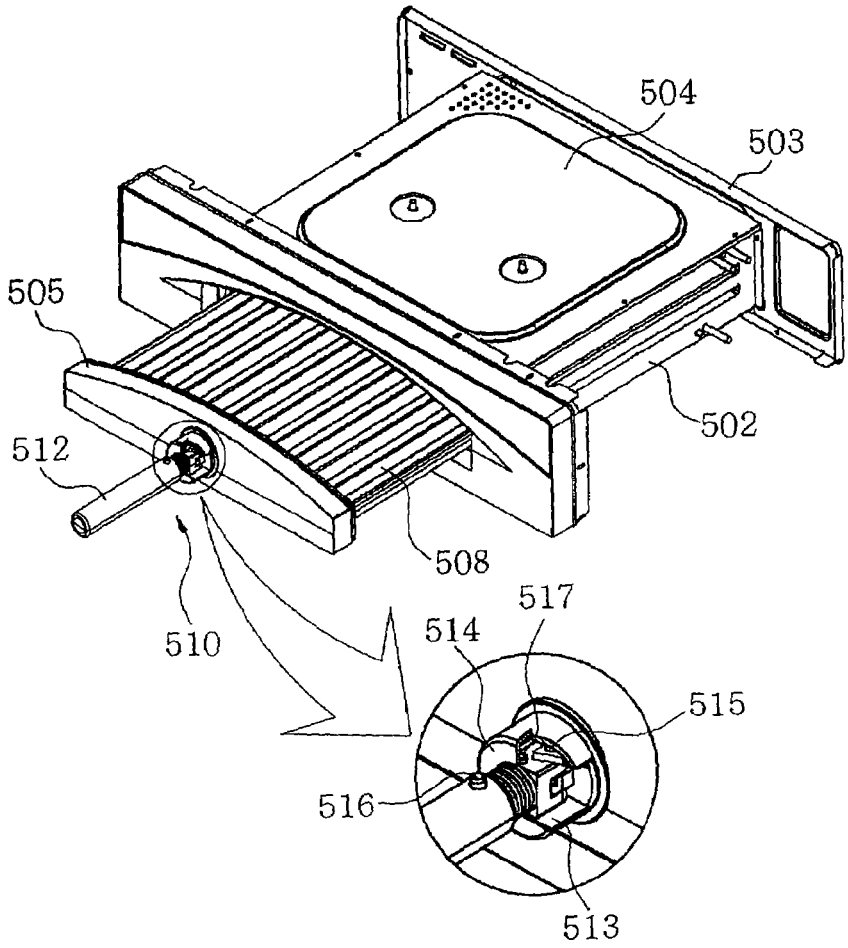
FIG. 8 is an exploded perspective view illustrating a pizza oven incorporated in a microwave oven in accordance with a fifth embodiment of the present invention.
Figure 9A:
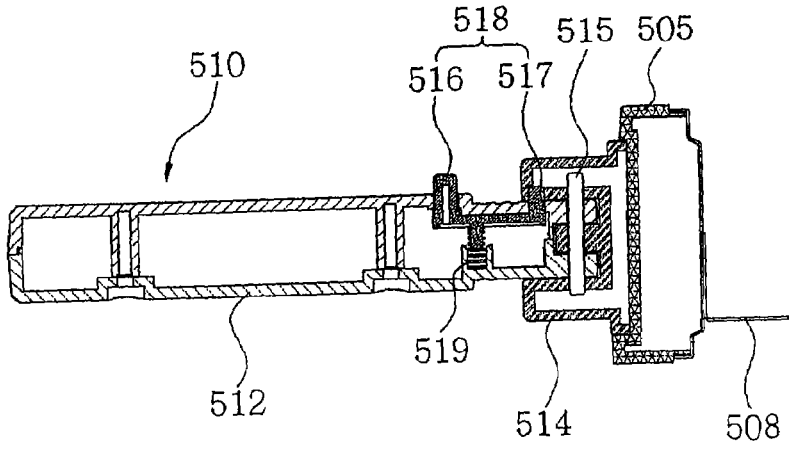
FIGS. 9A and 9B are sectional views of the pizza oven according to the fifth embodiment of the present invention.
Figure 9B:
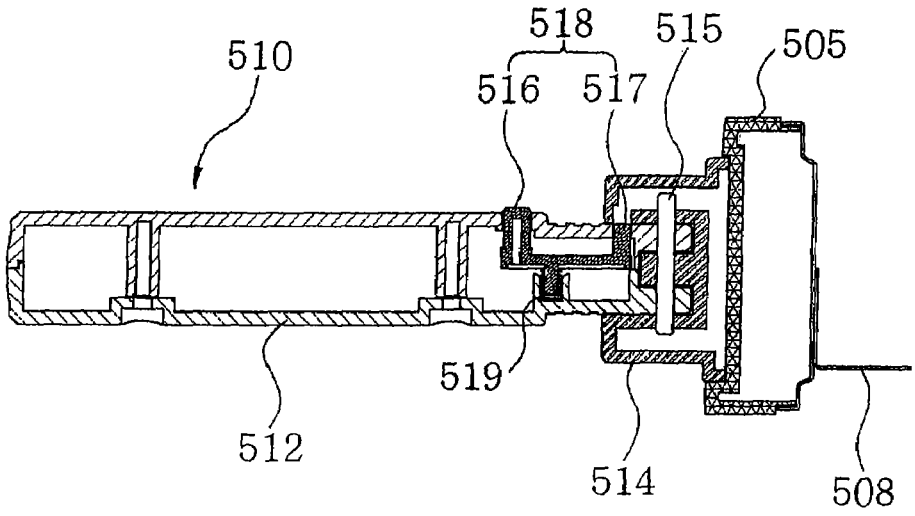
Figure 10:
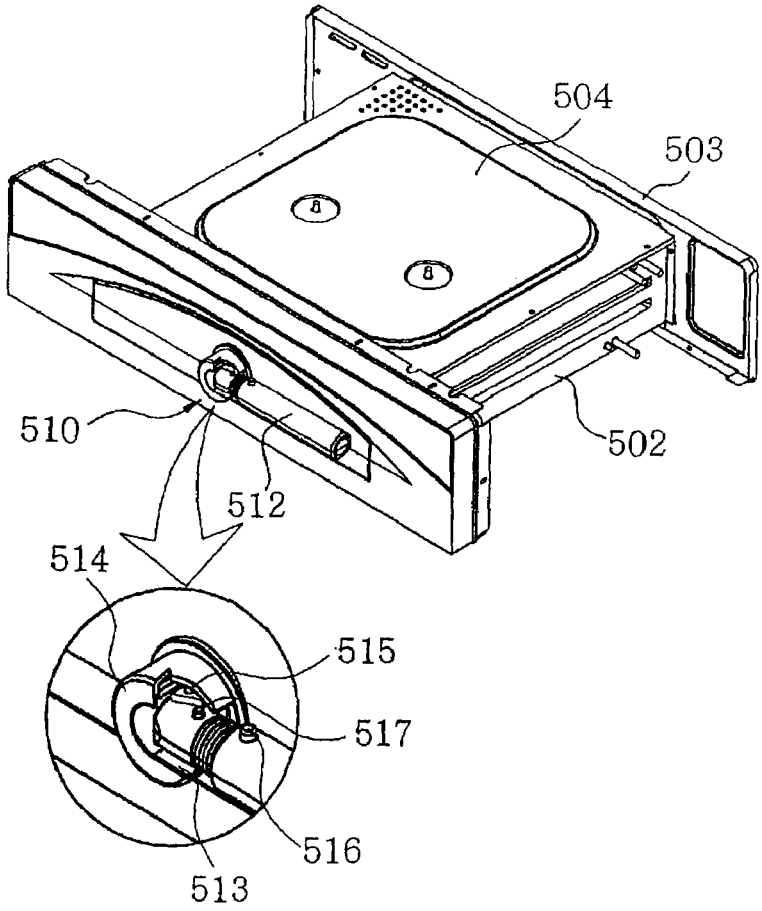
FIG. 10 is a perspective view illustrating the condition in which the pizza oven according to the fifth embodiment of the present invention is in a non-used state.

FIG. 8 is an exploded perspective view illustrating a pizza oven incorporated in a microwave oven in accordance with a fifth embodiment of the present invention. FIGS. 9A and 9B are sectional views of the pizza oven according to the fifth embodiment of the present invention. FIG. 10 is a perspective view illustrating the condition in which the pizza oven according to the fifth embodiment of the present invention is in a non-used state.

As shown in FIG. 8, the microwave oven according to the fifth embodiment of the present invention includes a pizza oven chamber 502 defined, only to cook pizza, in an upper portion of the microwave oven, which includes a cooking chamber (not shown) arranged in a lower portion of the microwave oven to cook food, using microwaves or heat from an electric heater.

The pizza oven includes a pizza oven body mounted to an oven body of the microwave oven, a pair of heaters 504 respectively mounted to the pizza oven body to define the top and bottom of the pizza oven chamber 502, a frame 503 mounted to the pizza oven body to define the rear side of the pizza oven chamber 502. The pizza oven body is opened at the front side thereof. The pizza oven also includes a door 505 slidably movable with respect to the front side of the pizza oven body to open/close the pizza oven chamber 502.

A foldable handle 510 is hingably mounted to the outer surface of the door 505 such that the foldable handle 510 hinges between a folded state and an unfolded state. The foldable handle 510 can be maintained in the unfolded state. The foldable handle 510 includes a circular bar-shaped handle section 512 hingably mounted to a bracket 514 fixed to the front surface of the door.

The structure of the foldable handle 510 will be described in more detail. The handle section 512 of the foldable handle 510 has a hollow circular bar shape to allow the user to grasp the handle section 512, and is hingably mounted to the bracket 514 fixed to the door 505. A hinge 515 is provided at the bracket 514 to hingably mount the handle 510 to the bracket 514 such that the handle 510 is horizontally hingable.

In order to allow the handle 510 to hinge horizontally, the bracket 514 is formed with a horizontal slit 513 to open one side of the bracket 514. The slit 513 guides a portion of the handle section 512 arranged adjacent to the hinge 515 during the hinging operation of the handle 510.

As shown in FIG. 9A, a lever 518 is mounted in the interior of the handle section 512 such that the lever 518 is movable only in a vertical direction. The lever 518 is provided, at one end thereof, with a pusher 516 upwardly protruded through a hole formed at the lever 518. The lever 518 is also provided, at the other end thereof, with an engagement protrusion 517 to be selectively engagable with engagement holes formed on an inner surface of the bracket 514 at positions respectively corresponding to the opposite ends of the slit 513, and thus, to temporarily hold the handle 510 at those positions. The opposite ends of the slit 513 correspond to the completely-folded and completely-unfolded positions of the handle 510 respectively. An elastic means 519 is also mounted in the interior of the handle section 512 beneath the lever 518 to elastically support the lever 518. Although not designated by reference numerals, guide members are provided at the lever 518 and the handle section 512 to guide the vertical movement of the lever 518, respectively.

As shown in FIG. 9B, the pusher 516 of the lever 518 is upwardly protruded from the handle section 512 at a position near the hinging end of the handle section 512 so that the user can push the pusher 516 in a state of grasping the handle section 512. When the user pushes the pusher 516, the lever 518 is downwardly moved, so that the engagement protrusion 517 is downwardly moved to be disengaged from the engagement hole of the bracket 514, in which the engagement protrusion 517 has been engaged. In this state, accordingly, the handle 510 is hingable. On the other hand, when the pushing force applied to the pusher 516 is released, the lever 518 is upwardly moved by the elastic force of the elastic means 519, thereby causing the engagement protrusion 517 to be engaged with the engagement hole of the bracket 514. Thus, the position of the handle 510 is fixed.

Hereinafter, the operation of the microwave oven according to the fifth embodiment of the present invention will be described.

In the microwave oven, which has a pizza cooking function, the foldable handle 510 hingably mounted to the door 505 is maintained in its folded state, as shown in FIG. 10, when the pizza oven is in a non-used state, in order to prevent the foldable handle 510 from interfering with the user or other objects.

When the pizza oven is to be used, the door 505 must be opened. For the opening of the door 505, it is necessary to unfold the foldable handle 510. In order to unfold the foldable handle 510, the user first presses the pusher 516 of the lever 518 arranged in the foldable handle 510 to downwardly move the lever 518.

In accordance with the downward movement of the lever 518, the engagement protrusion 517 is disengaged from the engagement hole of the bracket 514, in which the engagement protrusion 517 has been engaged. In this state, the foldable handle 510 is freely hingable. When the user subsequently hinges the foldable handle 510 along the slit 513 until the foldable handle 510 is completely unfolded in a forward direction such that the handle section 512 is rendered to be perpendicular to the outer surface of the door 505, the engagement protrusion 517 is allowed to move upwardly through the other engagement hole of the bracket 514. As a result, the lever 518 is upwardly moved by the elastic force of the elastic means 519, so that the engagement protrusion 517 is engaged with the engagement hole of the bracket 514. Thus, the foldable handle 510 is fixed at its completely-unfolded position.

In the completely-unfolded position, the foldable handle 510 extends in a direction perpendicular to the door 505. Accordingly, the user can easily pull the handle section 512 to forwardly move the door 505, and thus, to open the pizza oven chamber 502.

Since the foldable handle 510 is in a state of extending in the direction perpendicular to the door 505, the foldable handle 510 can effectively support the weight of the door 505 integrally carrying the pizza tray 508. Accordingly, it is possible to perform the procedures of inserting and ejecting the door 505 and pizza tray 508 without any problem.

As described above, in accordance with the fifth embodiment of the present invention, the foldable handle 510 of the door 505 is hingable about the hinge 515. Accordingly, it is possible to protrude the foldable handle 510 only when the foldable handle 510 is to be used, and thus, to effectively support the weight of the door 505 and pizza tray 508. The foldable handle 510 can be folded after the use thereof so that the foldable handle 510 can be stored in a state of being in contact with the door 505. Since the foldable handle 510 is also temporarily fixed at the completely-folded and completely-unfolded positions, the opening/closing operation of the door 505 and the storage of the foldable handle 510 can be stably achieved.

Figure 11:
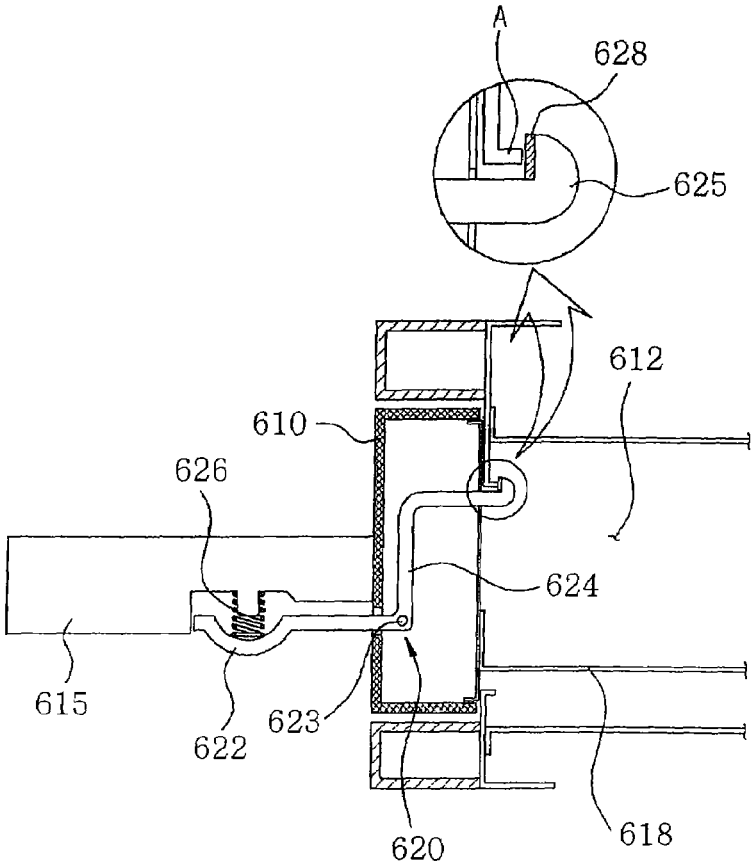
FIG. 11 is a front sectional view illustrating a pizza oven door according to a sixth embodiment of the present invention.
Figure 12:
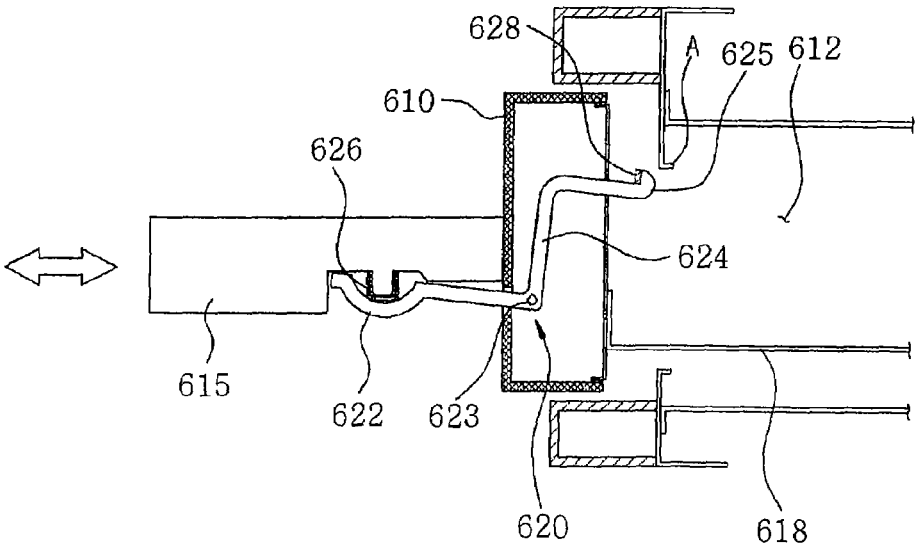
FIG. 12 is a sectional view illustrating a use state of the pizza oven door shown in FIG. 11

FIG. 11 is a front sectional view illustrating a pizza oven door according to a sixth embodiment of the present invention. FIG. 12 is a sectional view illustrating a use state of the pizza oven door shown in FIG. 11.

As shown in FIG. 11, the microwave oven according to the sixth embodiment of the present invention includes a pizza oven chamber 612 defined, only to cook pizza, in an upper portion of the microwave oven, which includes a cooking chamber (not shown) arranged in a lower portion of the microwave oven to cook food, using microwaves or heat from an electric heater.

The pizza oven includes a pizza oven body mounted to an oven body of the microwave oven. A heater is mounted to the pizza oven body in the pizza oven chamber 612 to generate heat required for cooking of pizza. The pizza oven also includes a door 610 separably mounted to the pizza oven body at the front side of pizza oven chamber 612 to open/close the pizza oven chamber 612. A handle 615 is mounted to the outer surface of the door 610 to extend in perpendicular to the door 610.

A seal locking means 620 is provided at the door 610 to bring the door 610 sealably into contact with an inlet end of the pizza oven chamber 612.

The seal locking means 620 includes a locking lever 624 hingably mounted, at an intermediate portion thereof, to a hinge 623 arranged in the interior of the door 610. The locking lever 624 has opposite ends extending beyond the outer and inner surfaces of the door 610, respectively.

A pusher 622 extends from one end of the locking lever 624 extending beyond the outer surface of the door 610. The pusher 622 is integral with the locking lever 624 and has a bent shape. The pusher 622 is arranged at a position where the user can easily press the pusher 622. A locker 625 is formed at the other end of the locking lever 624 extending beyond the inner surface of the door 610. The locker 625 is engagable with an edge of the pizza oven body defining an inlet edge of the pizza oven chamber 612, for example, an upper edge A in FIG. 2, to lock the door 610 in a position where the door 619 comes into close contact with the inlet of the pizza oven chamber 612. The pusher 622 and locker 625 are interlocked to hinge about the hinge 623.

In order to bring the door 610 into close contact with the inlet of the pizza oven chamber 612 by the locker 625, an elastic member 626 is interposed between the pusher 622 and a portion of the handle 615 facing the pusher 622 to force the pusher 622 to move away from the handle 615, and thus, to force the locker 625 to move toward the inlet end of the pizza oven chamber 612. That is, the locking lever 624 is always forced to hinge about the hinge 623 in a counter-clockwise direction, thereby always forcing the locker 625 of the locking lever 624 to come into contact with the upper edge A of the pizza oven chamber 612.

In accordance with the sixth embodiment of the present invention, an elastic seal pad 628 may be attached to the locker 625. By the elastic seal pad 628, the locker 625 can absorb the elastic force of the elastic member 625 when the locker 625 comes into contact with the upper edge A of the pizza oven chamber 612 under pressure. Accordingly, a reliable seal effect is established between the door 610 and the pizza oven chamber 612.

The operation of the microwave oven according to the sixth embodiment of the present invention will now be described.

When it is desired to cook a pizza in the microwave oven, which has a pizza cooking function in accordance with this embodiment, the pizza oven arranged in the upper portion of the microwave oven is used. The pizza oven is used under the condition in which the door 610 seals the inlet of the pizza oven chamber 612 in a state of being locked to the pizza oven chamber 612. The seal condition established between the door 610 and the pizza oven chamber 612 will be described hereinafter.

When the user presses the pusher 622 arranged beneath the handle 615 while grasping the handle 615, in order to separate the door 610 from the pizza oven chamber 612, and thus, to open the pizza oven chamber 612, the pusher 622 is moved while compressing the elastic member 626, thereby causing the locking lever 624 integral with the pusher 622 to hinge about the hinge 623.

In accordance with the hinging operation of the locking lever 624, the locker 625, which has been engaged with the upper edge A of the pizza oven chamber 612 while pressing the upper edge A, is disengaged from the upper edge A.

As a result, the door 610 is separable from the pizza oven chamber 612 to open the pizza oven chamber 612. When the user pulls the handle 615 in this state, the door 610 opens the pizza oven chamber 612 while being separated from the pizza oven chamber 612, as shown in FIG. 12. Where the door 610 integrally carries a pizza tray 618, the pizza tray 618 is ejected from the pizza oven chamber 612, simultaneously with the separation of the door 610. Thus, the user can lay a pizza, to be cooked, on the pizza tray 618. In this state, the user may release the force applied to the pusher 622. Under this condition, the locking lever 624 and locker 625 are returned to their original positions by the elastic member 626.

When the user completes a preparation procedure to initiate a pizza cooking operation by laying a pizza, to be cooked, on the pizza tray 618, he pushes the door 610 to insert the pizza tray 618 into the pizza oven chamber 612 while grasping the handle 615. In accordance with the pushing operation of the user, the door 610 closes the pizza oven chamber 612. In this case, it is preferred that the user again press the pusher 622 to hinge the locking lever 624 in the same manner as described above, and thus, to reliably engage the locker 625 with the upper edge A of the pizza oven chamber 612. Thus, the door 610 is securely fixed to the pizza oven chamber 612, and the pizza tray 618 is securely arranged in position in the pizza oven chamber 612.

Under the condition in which the door 610 is securely in contact with the inlet of the pizza oven chamber 612, the user can release the force pressing the pusher 622. When the force pressing the pusher 622 is released, the elastic member 626 forces the pusher 622 to move away from the handle 615, thereby causing the locking lever 624 to hinge about the hinge 623.

In accordance with the hinging operation of the locking lever 624, the locker 625 is engaged with the upper edge A of the pizza oven chamber 612 while pressing the upper edge A by virtue of the elastic force of the elastic member 626. As a result, the door 610 is forced toward the inlet of the pizza oven chamber 612. That is, the locker 625 is pressed against the upper edge of the pizza oven chamber 612 by virtue of the elastic force of the elastic member 626, thereby causing the door 610 to be pulled toward the inlet of the pizza oven chamber 612. Accordingly, the door 610 completely seals the pizza oven chamber 612, thereby preventing heat energy from being leaked from the pizza oven chamber 612.

Meanwhile, when the locker 625 is pressed against the upper edge A of the U<pizza oven chamber 612, the elastic seal pad 628 attached to the locker 625 provides an enhanced seal effect between the locker 625 and the upper edge A of the pizza oven chamber 612 while preventing friction from being generated between the locker 625 and the upper edge A of the pizza oven chamber 612.

Thus, in accordance with this embodiment of the present invention, the locking lever 624, which is hingable about the hinge 623, is hinged by a pressing force applied to the pusher 622 to disengage the locker 625 from the inlet end of the pizza oven chamber 612, and thus, to open the pizza oven chamber 612. Also, when the pressing force applied to the pusher 622 is released, the elastic member 626 forces the locking lever 624 to hinge about the hinge 623, and thus, to cause the locker 625 to come into close contact with the inlet of the pizza oven chamber 612. Accordingly, the door 610 can securely seal the pizza oven chamber 612.

As apparent from the above description, the pizza oven door according to the present invention has a structure in which a pan is integrally mounted to the door, and a handle is separably mounted to the outer surface of the door. Accordingly, the user can simultaneously achieve opening of the door and ejection of the pan by simply pulling the handle after coupling the handle to the door. Since the user can couple the handle to the door or separate the handle from the door in accordance with his desire, the convenience of the user is enhanced.

In accordance with the door structure of the microwave oven, which is usable as a pizza oven, there is no difficulty in ejecting a cooked pizza from a pizza oven equipped in the microwave oven. Accordingly, an enhancement in use convenience is achieved.

In accordance with the door handle structure of the microwave oven, in which a pizza oven is incorporated, it is possible to eliminate the difficulty caused by the weight of an oven door and the weight of a pizza tray in ejecting a cooked pizza from the pizza oven. Accordingly, an enhancement in use convenience is achieved.

In the door structure of the pizza oven incorporated in the microwave oven in accordance with the present invention, it is possible to prevent heat energy form being leaked from the pizza oven, and thus, to achieve an enhancement in cooking performance. Since the door can be locked to the pizza oven chamber, it is possible to prevent the pizza oven chamber from being unintentionally opened, so that an enhancement in reliability is achieved.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A door structure of a microwave oven usable as a pizza oven, the microwave oven comprising:

an oven body, a cooking chamber defined in the oven body, and a pizza oven chamber defined in the oven body while being separate from the cooking chamber, the door structure comprising:

a door to open/close the pizza oven chamber; and a foldable handle hingably mounted to an outer surface of the door such that the foldable handle hinges between a folded state and an unfolded state, and is able to be maintained in the unfolded state, wherein the foldable handle comprises:

a handle section having a circular bar shape;

a bracket to mount the handle section to an outer surface of the door;

a hinge to hingably mount the handle section to the bracket such that the handle section hinges horizontally;

a slit formed at one side of the bracket to open one side of the bracket and to guide the horizontal hinging operation of the handle section;

a lever to temporarily hold the handle section at positions respectively corresponding to opposite ends of the slit, the lever having a pusher, and an engagement protrusion to be engaged with the bracket at the holding positions and to be disengaged from the bracket in accordance with a pushing operation of the pusher, and means for elastically supporting the lever such that the engagement protrusion is always forced in an engaging direction.

* * * * *